United States Patent [19]

Clay

[11] 4,181,546

[45] Jan. 1, 1980

[54] WATER RESISTANT BLASTING AGENT AND METHOD OF USE

[76] Inventor: Robert B. Clay, 728 W. 3800 South St., Bountiful, Utah 84010

[21] Appl. No.: 936,926

[22] Filed: Aug. 25, 1978

Related U.S. Application Data

[63] Continuation-in-part of Ser. No. 834,772, Sep. 19, 1977, Pat. No. 4,111,727.

[51] Int. Cl.[2] ..... C06B 45/02

[52] U.S. Cl. ..... 149/21; 149/2; 149/41; 149/43; 149/44; 149/46; 149/61; 149/76; 149/83; 149/85

[58] Field of Search ..... 149/44, 46, 2, 61, 76, 149/83, 85, 41, 43, 21

[56] References Cited

U.S. PATENT DOCUMENTS

| | | | |
|---|---|---|---|
| 4,104,092 | 8/1978 | Mullay | 149/46 X |
| 4,111,727 | 9/1978 | Clay | 149/46 X |

*Primary Examiner*—Stephen J. Lechert, Jr.

[57] ABSTRACT

A pourable blasting agent of high water resistance, having controlled density and bulk blasting strength greater than that of conventional ammonium nitrate-fuel oil (ANFO) mixtures, comprises two main essential components, i.e. (1) 40 to 60% by weight of a dry or essentially dry, solid, particulate oxidizer salt, with or without added fuel oil for oxygen balance and (2) 60 to 40% of a water-in-oil emulsion containing oxidizer salt dissolved in water and combined with an oily vehicle held in stable emulsion condition with a small quantity of water-in-oil emulsifier, the emulsion also containing a density controlled sensitizer such as hollow glass beads, polystyrene beads, microballoons or equivalent. The first component is preferably a fertilizer grade prilled ammonium nitrate, with or without added oil; the second is of heavy oil or grease consistency having high resistance to the extraction of salt therefrom in water and being of substantially higher bulk density than the particulate material. The components are thoroughly mixed together to substantially eliminate voids between the solid granules. The oily or greasy emulsion contains enough oil, with or without other fuels, to give substantial oxygen balance to the whole mixture. The required quantity of a highly effective emulsifier is minimized by high shear mixing to insure a stable emulsion of the second component.

18 Claims, No Drawings

WATER RESISTANT BLASTING AGENT AND METHOD OF USE

The present application is a continuation in part of earlier application, Ser. No. 834,772, filed Sept. 19, 1977 by the present inventor, now U.S. Pat. No. 4,111,727, issued Sept. 5, 1978.

BACKGROUND AND PRIOR ART

As described in said earlier application, and as is well known in the art, the relatively expensive compound explosives such as TNT and the like have largely been replaced for hard rock blasting, as in mining, excavation and construction operations, by less expensive agents based largely on the use of fertilizer grade ammonium nitrate (FGAN). A particularly important agent of the less expensive type is that made up by lightly coating ammonium nitrate prills with fuel oil, about 6% of oil being combined with about 94% of the nitrate. The resulting mixture, often referred to as "ANFO", is not as powerful, in bulk strength, as TNT, but is much less expensive. It can be poured into dry boreholes and detonated with reasonable sized boosters, under dry field conditions. However, it has some disadvantages, particularly where ground water is encountered and the boreholes become filled or partly filled with water. While individual prills of ammonium nitrate have a density of 1.40 g/cc or more, nitrate prills in bulk have a density of only about 0.85. Ground AN is not much denser. Mixtures of either granules or prills with oil have about the same bulk density. The addition of fines, or of heavier fuel materials such as ferro-silicates or ferro-phosphorus may increase density so that the packaged mixture will sink in water but some of these are expensive or have other disadvantages. As a consequence, the bulk blasting power of conventional "ANFO" is relatively low; it will not sink in water if placed inside waterproof bags or liners, in water filled holes, and it has very low resistance to water-leaching of the salts.

To avoid some of these difficulties, slurries of explosive composition have been developed, with success for some uses. They often have higher bulk density but they require expensive fuels such as finely divided aluminum and/or particulate self-explosive components, such as TNT, smokeless powder, and the like. In order to make them water resistant, these slurries have been compounded with gelling agents which in turn have required the use of stabilizers and density controlling agents or other measures. They usually require sophisticated mixing plants which are difficult or too expensive to set up at blasting sites. The slurries are often aerated, to impart sensitivity, as they are difficult to detonate, and the aeration is itself unstable or contributes to instability. Liquid fuels such as alcohols, glycols, amides and the like, usually of organic nature, have been added to them, sometimes with benefit but usually with addition to costs. There is therefore a great need for an inexpensive explosive composition which is relatively dense, so that it will sink in water, which is water resistant, which has good bulk blasting power or energy, and which can be reliably detonated without being hazardous to handle. To produce such is a major object of the present invention.

Further objects are to minimize costs, consistent with good performance, and to devise uses or methods of use which effect further economy in blasting operations.

The composition of the present invention is essentially a well mixed combination of two major ingredients, namely, an essentially solid, dry, granular or prilled form of oxidizing salt, usually ammonium nitrate, although other nitrates, chlorates or perchlorates may be substituted in part, at least, and an oily or greasy emulsion made up of powerful oxidizer salts dissolved in water and stably emulsified into an oily external phase where they are held by an effective though small amount of a water-in-oil emulsifier. The first major component being of relatively low bulk density, it is necessary that the other component be fluid enough to fill the interstices in the ANFO so as to produce an explosive of higher overall density than that of water. But the density must not be so great that the composition cannot be detonated by practical sized boosters in reasonable columnar diameters so a density controlling sensitizer is added, preferably in the form of hollow microspheres or microballoons of polystyrene or styrofoam or the like, in appropriate proportions. The composition described in the parent application, Ser. No. 834,772, described use of emulsion slurry to partly fill the interstices between the prills. It has been found that water resistance is improved if these interstices are filled as completely as possible. However, without density control such compositions do not detonate satisfactorily.

The prior art has also suggested the combination of grease-like materials with ammonium nitrate prills or prills and oil, as in British Pat. No. 1,306,456, for example. In that reference, a solution of ammonium and other nitrates in water was emulsified with oil and fertilizer grade ammonium nitrates, with or without oil added thereto, were combined with the emulsion, but the compositions required addition of hydrogen peroxide and/or other sensitizers, plus much larger quantities of emulsifier and there were other differences in proportions that made the composition quite different from the present. The compositions described in the Butterworth patent require much more emulsifier and in general, they are not suitable for use in deep boreholes unless a density reducing agent should be added, because the presence of a tall column increases the density so much that they are difficult or impossible to detonate. Several prior art references mention water in oil emulsions, usually employed as such as blasting agents, as in Bluhm, U.S. Pat. No. 3,447,078, and British Pat. Nos. 1,329,512 and 1,335,097 to DuPont, and 1,405,348 to ICI. Egly and Neckar, U.S. Pat. No. 3,161,551 suggest use of water in oil emulsifiers to sensitize and fill voids in ammonium nitrate prills, for blasting purposes; Wilson et al, U.S. Pat. No. 3,287,189 suggests coating the prills with a soap before adding oil to improve water resistance.

The water-in-oil emulsifiers used in the present inventions must be efficient ones as they are used in very small proportions. Particularly suitable emulsifiers are such materials as sorbitan monooleate, -monostearate, or -monopalmitate and analogous derivatives of these and other long chain acids. Esters of the fatty acids may be used, such as the isopropyl ester of lanolin fatty acids. Various others are suitable if they have the needed hydrophilic content and an oil-soluble chain or branch, as it is known in the art. Certain metal salts of higher fatty acids, such as sodium oleates, amine derivatives such as triethanolamine oleate, are useful. Lauryl amine acetate and related amides of fatty materials such as tall oil may be used, such as a commercial product "EZ-Mul", as named by the manufacturer, Baroid Division of National Lead Co., which is understood to be the tall oil amide of tetraethylene penta-amide. Other emulsifiers are known and suitable if they are efficient water-in-oil emulsifiers. Preferred proportions are from as little as 0.02% to 0.3% based on the weight of the total composition. Others found satisfactory are "Armac 18D" and "Armeen" 18, produced by Armak Chemical Div., "Agrimul 26B" (Diamond Shamrock) and "Span 85" and "Span 65", of ICI America. The "Glycomul O" is superior to most for the present invention. The invention will be more fully understood by reference to a detailed description of a preferred embodiment, which follows:

DESCRIPTION OF PREFERRED EMBODIMENT

A first component was made up of 94% by weight of prilled, fertilizer grade ammonium nitrate, lightly coated with 6% by weight of a conventional No. 2 fuel oil. The granules, after coating, were essentially dry. The bulk density of this component was about 0.85 g./cc. The second component was made up of 41 parts by weight of ammonium nitrate, 41 parts of a commercial calcium nitrate (Norsk Hydro Calcium Nitrate) which contained some ammonium nitrate, 9.75% of water, 6.5% of No. 2 fuel oil, 0.17% of a commercial water-in-oil emulsifier, which has a good water soluble atom or group, and an oil-soluble group, and 1.5% by weight of polystyrene beads. These beads had an individual particle density of about 0.08 g./cc. and a bulk density of about 0.04. They ranged in particle size from a minus 20 to plus 30 mesh size. The second component was heated mildly for mixing but the beads were not added until the temperature dropped below 40° C., because it was noticed that the beads tended to soften and collapse if added at higher temperature.

The two components just described, were combined in equal proportions by weight; that is, in a 50/50 mix. The second component, the emulsified slurry, was a greasy heavy oil in appearance, with a density of 1.5 g./cc. before addition of the beads. After addition, density dropped to about 1.15 and when combined with the dry material, component 1, the overall bulk density was 1.25. The mixture poured like wet concrete. The second or slurry component made up with No. 2 fuel oil was more like an oil than a grease in consistency. When a 50/50 mixture of No. 2 fuel oil and No. 5 Bunker oil was used, the emulsion was considerably stiffer.

The emulsifier specifically used above was a sorbitan monooleate, available from Glyco Chemicals Inc. as "Glycomul O". Other emulsifiers can be used, but it was found that larger quantities of some were needed than of this one. Emulsifier requirements increased unless a high shear mixer was used. An ordinary mixer or beater was inadequate to obtain the fine stable emulsion needed without considerably increasing the amount of emulsifier. It is desirable, for reasons of economy, to keep the latter to a minimum and it was found that proportions of as low as 1/40th%, based on weight of the total composition, was sufficient if a high grade emulsifier is used and a high shear rate emulsification operation is followed. Proportions of the emulsifier need not exceed about 0.1 percent if a high shear rate operation is used for making the emulsion.

The composition of the foregoing example, with its density of 1.25, was placed in a water filled borehole with a head of 55 feet of water (25 psig). Its density under this water pressure increased to 1.30 but it was still detonable with a moderate sized booster so this density and compression can be tolerated. In the case of aerated slurries of the prior art, the compression under a head amounting to 25 psig. would so compress the aeration bubbles as to make the agent undetonable, and hence useless. In one case, a gassed composition of 1.25 density increased to 1.39 when pressure of 25 psig was applied. This cannot be tolerated as the composition cannot be shot.

In the above composition, the amount of emulsifier was only 0.05%, based on weight of the total composition. Using a high speed emulsifier or colloid mill, a stable emulsion can be made with only 0.025% of emulsifier.

The following tabulation shows relative and comparative properties of the composition described above and of conventional "ANFO".

| | 50/50 Slurry ANFO | Simple ANFO |
|---|---|---|
| Bulk density | 1.25 | 0.85 |
| Ingredient cost | 1.15 | 1.00 |
| Weight strength | 0.87 | 1.00 |
| Bulk strength | 1.28 | 1.00 |
| Water resistance | Good | Poor |
| Flowability | Good | Good |
| Critical Diameter | 6" | 4" |
| Minimum Booster Req. | 130 g. Pentolite | 20 g. Pentolite |
| Detonation velocity | 3000 m./sec. | 2500 m./sec. |
| Storage stability | Good | Good |

These products were fired at 5° C. temperature in cardboard tubes. The advantages of the composition of this invention are important in cost, bulk density, bulk strength, water resistance and in detonation velocities.

The slurry-ANFO composition of this invention contains too high a proportion of dry ingredient to be pumpable in conventional slurry pumps but it can be poured like concrete and can be delivered by an auger in the same manner as dry ANFO.

By adding the normal ANFO oil content directly to the slurry and using entirely unoiled nitrate prills for the dry ingredient, the mixture becomes somewhat more liquid than if ordinary ANFO is used and less oil in the emulsion. A composition made up of 40% ANFO and 60% emulsion pours about like motor oil if the oil in the emulsion is a No. 2 heating oil. When the oil in the ANFO is added first to the emulsion, making about a 62.5% emulsion, 37.5% dry mix, the material is easily poured. For most purposes, a mix of about 40 to 60% emulsion and 60 to 40% ingredients (ANFO or straight ammonium nitrate prills), is quite satisfactory.

Using various quantities of polystyrene beads of minus 20 to plus 30 mesh size to control density, the following results were obtained:

| Mixture | Density | Diam. | Results |
|---|---|---|---|
| 50/50 Emuls-ANFO | 1.16 g./cc. | 4" | Detonated |
| 50/50 Emuls-ANFO | 1.20 | 4" | Failed |
| 60/40 Emuls-ANFO | 1.16 | 5" | Detonated |

The last of the compositions tabulated above was poured slowly through two feet of water and was then shot without moving the 5 inch tube. No salt could be tested in the water above the mix.

Several factors have been noted which affect the stability of the slurries of the present invention.

(1) Choice of emulsifier: About two thirds of several dozen emulsifiers tested do not produce a good emulsion at all. Some of the others were found to be less desirable than the best. The sorbitan oleate type (Glycomul O) was found to be among the most satisfactory. Some of the others made reasonable good emulsions but required considerably larger quantities of emulsifier. The emulsifier must have sufficient solubility in water to form the water-in-oil emulsion.

(2) Effect of use of deficient quantities of emulsifier: An emulsion slurry made with 1/15th% (0.067%) of "Glycomul O" separated to let oil form on top of the salt crystals after three cycles of warming and cooling from −20° C. to +20° C. The same mixture with 1/6th% of the same emulsifier remained stable after four cycles.

(3) Effect of heavier fuel oil: Using an oil made by mixing equal quantities of No. 2 fuel oil and No. 5 Bunker oil, a more stable emulsion slurry was made than when the oil was all of the No. 2 grade. It has been found possible to use 100% Bunker oil but it is very sticky and does not soak into and fill the interstices in the prills as well as the thinner oil. Broadly, the fuel may be one or more selected from the group which consists of hydrocarbon fuel oils, aromatic hydrocarbons, kerosene, naptha, paraffin wax, vegetable oils, fish oils, reclaimed motor oil, and oily derivatives of olefins which can be melted to liquid form in preparing the emulsion.

(4) Effect of energetic mixing: Using 1/4% of an emulsifier, and stirring with a motor driven paint stirrer at about 1500 rpm. the mix broke down in one cycle of heating and cooling as above. The same mix, blended in a Waring blender, (about 10,000 rpm.) not only was unchanged after five cycles but was much more viscous. It therefore appears that a good shearing mixing together with a good emulsifier is needed to obtain a good stable emulsion.

(5) Effect of different salt combinations in the solution that is slurried: The solution for a product described in the parent application, Ser. No. 834,772, which contained about 28 parts by weight of ammonium nitrate, 48 parts of the Norsk calcium nitrate, 5 parts of sodium nitrate and 10 parts of water, had a crystalization point of 16° C. and formed a more stable slurry emulsion than similar mix made with 41 parts ammonium nitrate, 41 parts Norsk Calcium Nitrate and 10 parts of water. The latter had a crystalization point of 40° C. In general, the essentially solid constituent will have 20 to 60% of AN, and up to 35% each of sodium nitrate, calcium nitrate and/or potassium nitrate.

The use of a mixture of salts instead of straight ammonium nitrate in the aqueous solution that is to be emulsified has advantages in that greater quantities of two salts can be dissolved in a given quantity of water than of a single salt. Eutectics are well known in the prior art. It is desirable to have the salts in aqueous solution remain in that solution during emulsification with the oil. The proportions of the various ingredients in this solution may be varied rather widely but ammonium nitrate should comprise a substantial part of the mixture. While various emulsifiers may be used, it is desirable that they have about as good emulsifying qualities as the sorbitan oleates mentioned above. The slurry may contain liquid fuel such as ethyl or methyl alcohol, amides, glycols, etc. as in the prior art, as long as it also contains enough oil or oleaginous material to make a stable water-in-oil emulsion. The oil need not be one that is normally a free flowing liquid. It may be quite solid at ordinary temperatures. Heavy oils and greases which can be effectively emulsified when warmed may be used. In fact, the emulsion component itself, which is to be mixed with the ammonium nitrate dry particles, or with ANFO, may itself be quite a stiff grease in consistency and viscosity, as long as it can be effectively worked into the interstices between the solid grains of oxidizer. If it does not fill these quite completely, water will penetrate and will ultimately destroy the explosive agent. If exposure to water is very brief and transient, the emulsion need not be as fully waterproof as in the case where it is to stand in water overnight or for longer periods of time before shooting.

It will be apparent to those skilled in the art that various changes may be made in the composition of this invention without departing from the spirit and purpose thereof. It is intended by the claims which follow to cover these modifications and variations as broadly as the state of the prior art properly permits.

In cases where the borehole is only partly filled with water, the slurries of this invention may be poured into the water until they rise above it, after which the remainder of the borehole may be filled up to the level desired, with dry ANFO or enriched or heavy ANFO, i.e. ANFO to which some slurry, not necessarily waterproof, has been added. Since the greatest energy is required at the bottom, where there is more burden, this distributes the explosive materials economically, putting the strongest where it is most needed and using a cheaper material to finish the job towards the top where the full power of the more expensive material is really not required. This is another aspect of the invention which may be varied within the skill of the art, without departing from the spirit and purpose of this invention.

What is claimed is:

1. A blasting composition consisting essentially of a combination of:

(a) 40 to 60% by weight, based on the total composition, of a water-in-oil emulsion comprising powerful oxidizer salt in aqueous solution, said solution being dispersed in an outer continuous oil phase and including a gas-trapping density-reducing material to sensitize the composition and improve its detonability, (b) 60 to 40% by weight of a substantially solid particulate oxidizer consisting primarily of ammonium nitrate, and (c) the emulsion being blended through and into the solid particulate oxidizer so as to fill substantially completely the voids and interstices in and between the solid particles so as to substantially exclude water.

2. Composition according to claim 1 in which the oxidizers in the emulsion are selected from the group which consists of the ammonium, alkali metal and alkaline earth metal nitrates, chlorates and perchlorates.

3. A composition according to claim 1 in which the emulsion constituent per se is essentially oxygen balanced with a fuel oil and in which the particulate oxidizer material consists of ammonium nitrate substantially oxygen balanced with fuel oil.

4. A composition according to claim 1 in which the solid particulate material consists of ammonium nitrate and the emulsion component contains sufficient oil to oxygen balance the ammonium nitrate of the solid particulate component.

5. A composition according to claim 1 in which the emulsion component includes calcium nitrate and ammonium nitrate.

6. Composition according to claim 5 in which the emulsion component includes sodium nitrate.

7. A composition according to claim 1 in which the emulsion component includes an aqueous solution of ammonium nitrate and calcium nitrate and also includes a water soluble liquid fuel selected from the group which consists of the water soluble alcohols, glycols and formamide.

8. A composition according to claim 1 in which the oil includes an oleaginous material which is substantially solid at normal temperatures.

9. A composition according to claim 1 in which the fuel is one selected from one or more of the group consisting of hydrocarbon fuel oils aromatic hydrocarbons, kerosene, naptha, paraffin wax, vegetable oil, fish oil, reclaimed motor oil and oily derivatives of olefins which can be melted to liquid in preparing the emulsion.

10. A composition according to claim 9 in which a liquid oil is included both in the emulsion and in the solids component.

11. A composition according to claim 1 in which the water-in-oil emulsion contains about 0.02 to 0.3%, based on the weight of the total composition, of an emulsifier selected from the group which consists of sorbitan monooleate, sorbitan monostearate, sorbitan monopalmitate, sorbitan monolaurate, stearic acid, and long chain derivatives of metal which have emulsion forming solubility in water.

12. A composition according to claim 1 in which the substantially solid oxidizer includes up to 10% of liquid hydrocarbon fuel and otherwisecomprises 20 to 60% by weight of ammonium nitrate, up to 35% of sodium nitrate, up to 35% of calcium nitrate, and up to 35% of potassium nitrate.

13. A composition according to claim 1 having an overall oxygen balance between minus 12 and plus 4%.

14. An explosive composition according to claim 1 in which the slurry contains particulate fuel as well as an aqueous solution of nitrates of ammonium, calcium and an alkali metal, in which the solid particulate oxidizer consists essentially of ammonium nitrate treated with fuel oil to improve oxygen balance.

15. An explosive composition which comprises, in combination:

(a) an essentially solid nitrate oxidizer component in proportions of at least 40% by weight of the total,
(b) Up to 10% by weight of oily fuel mixed with the solid oxidizer component,
(c) a solid particulate fuel,
(d) 40 to 60% by weight of a dense water-in-oil emulsion blended into the solid oxidizer to substantially fill all voids and intersticies therein and therebetween, and
(e) finely dispersed hollow gas filled particles dispersed throughout the emulsion in sufficient quantity to reduce overall density and to add sensitivity to detonation.

16. A composition according to claim 15 in which the oxidizer consists of ammonium nitrate and at least one other nitrate to enhance water solubility.

17. An explosive composition according to claim 15 in which the emulsion slurry contains a water soluble fuel.

18. The method of blasting in situations where the borehole contains water in the lower portion thereof, which consists in filling the borehole up to the top of the water therein with a composition having particulate solid nitrate oxidizer filled in the interstices with water-in-oil emulsion slurry to protect said oxidizer from the water and filling the upper portion of the borehole with essentially dry ammonium nitrate-fuel oil or enriched ammonium nitrate-fuel oil, the bottom composition having greater density than water and higher bulk blasting power than ANFO and the composition, towards the top, being less costly than the bottom composition.

* * * * *